US010138092B2

(12) United States Patent
Turek

(10) Patent No.: US 10,138,092 B2
(45) Date of Patent: Nov. 27, 2018

(54) TRANSPORTATION ELEMENT FOR A PEOPLE CONVEYOR

(71) Applicant: Otis Elevator Company, Farmington, CT (US)

(72) Inventor: Alexander Turek, Münchendorf (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/649,003

(22) Filed: Jul. 13, 2017

(65) Prior Publication Data

US 2018/0016118 A1 Jan. 18, 2018

(30) Foreign Application Priority Data

Jul. 15, 2016 (EP) ..... 16179699

(51) Int. Cl.

| | |
|---|---|
| ***B65G 15/30*** | (2006.01) |
| ***B66B 21/10*** | (2006.01) |
| ***B66B 23/08*** | (2006.01) |
| ***B66B 23/10*** | (2006.01) |

(52) U.S. Cl.

CPC ..... *B66B 21/10* (2013.01); *B66B 23/08* (2013.01); *B66B 23/10* (2013.01)

(58) Field of Classification Search

CPC ..... B65G 15/30; B65G 17/067; B66B 23/10; B66B 23/028

USPC ..... 198/327, 845, 850

See application file for complete search history.

(56) References Cited

U.S. PATENT DOCUMENTS

| | | | | |
|---|---|---|---|---|
| 3,107,773 | A * | 10/1963 | Clemetsen | B65G 23/14 198/330 |
| 3,590,745 | A * | 7/1971 | Ouska | B65G 17/065 104/172.3 |
| 5,072,821 | A * | 12/1991 | Kruse | B66B 23/02 198/327 |
| 5,433,313 | A * | 7/1995 | Deschner | B65G 17/067 198/850 |
| 5,944,164 | A * | 8/1999 | Behle | B66B 23/12 198/327 |
| 6,607,064 | B2 | 8/2003 | Inoue | |
| 7,063,202 | B2 | 6/2006 | Ossendorf | |
| 7,341,139 | B2 | 3/2008 | Aulanko et al. | |
| 7,407,049 | B2 | 8/2008 | Aulanko et al. | |
| 7,410,043 | B2 | 8/2008 | Aulanko et al. | |
| 7,494,006 | B2 * | 2/2009 | Knott | B65G 17/08 198/850 |

(Continued)

FOREIGN PATENT DOCUMENTS

| | | | |
|---|---|---|---|
| DE | 10322568 | A1 | 12/2004 |
| DE | 102012110764 | A1 | 5/2013 |

(Continued)

OTHER PUBLICATIONS

European Search Report for application EP 16179699, dated Jan. 20, 2017, 7pgs.

*Primary Examiner* — Joseph A Dillon, Jr.

(74) *Attorney, Agent, or Firm* — Cantor Colburn LLP

(57) ABSTRACT

A transportation element (7; 8; 9) for a people conveyor (70), which is configured to be moved in a conveying direction, comprises a lower flange (24); an upper flange (22); and an intermediate element (26) connecting the upper the flange (22) with the lower flange (24).

17 Claims, 10 Drawing Sheets

(56) References Cited

U.S. PATENT DOCUMENTS

| | | | | |
|---|---|---|---|---|
| 7,611,007 | B2 * | 11/2009 | Lim | B65G 17/066 198/850 |
| 9,617,122 | B2 * | 4/2017 | Matheisl | B66B 23/10 |
| 9,718,647 | B2 * | 8/2017 | Makovec | B66B 23/10 |
| 2002/0046917 | A1 | 4/2002 | Okano et al. | |
| 2009/0250324 | A1 * | 10/2009 | Menke | B65G 17/40 198/845 |
| 2011/0233033 | A1 * | 9/2011 | Poels | B65G 17/44 198/845 |
| 2015/0259177 | A1 | 9/2015 | Srb-Gaffron et al. | |
| 2015/0284217 | A1 | 10/2015 | Park | |
| 2016/0221798 | A1 * | 8/2016 | Eidler | B66B 23/12 |
| 2016/0355379 | A1 * | 12/2016 | Matheisl | B66B 23/10 |

FOREIGN PATENT DOCUMENTS

| | | | |
|---|---|---|---|
| FR | 1416386 | A | 11/1965 |
| GB | 2264686 | A | 9/1993 |
| JP | H115680 | A | 1/1999 |
| WO | 2015010894 | A1 | 1/2015 |
| WO | 2015032674 | A1 | 3/2015 |
| WO | 2015058909 | A1 | 4/2015 |

* cited by examiner

TRANSPORTATION ELEMENT FOR A PEOPLE CONVEYOR

PRIORITY

This application claims priority to European Patent Application No. 16179699.0, filed Jul. 15, 2016, and all the benefits accruing therefrom under 35 U.S.C. §119, the contents of which in its entirety are herein incorporated by reference.

The invention relates to people conveyors, such as moving walkways or escalators, comprising a plurality of transportation elements, such as pallets or steps, forming an endless band (loop) which is movable in a conveying direction. The invention in particular relates to transportation elements to be employed in such conveyors.

In a people conveyor, the transportation elements are drivingly coupled to at least one conveying element. Usually the transportation elements are drivingly coupled to two chains provided on both lateral sides of the transportation elements. For avoiding interference of adjacent transportation elements in the turnaround portions of the loop, people conveyors usually are constructed with turnaround portions having diameters ("turnaround diameters") of more than 600 mm. In consequence, in order to avoid undesirable steps at the entry and exit portions (landings) of the people conveyor, pits having a considerable depth are necessary for accommodating the turnaround portions. Providing such pits increases the costs of the installation and it might not even be possible to form pits having the necessary depth in all situations.

It therefore would be beneficial to provide an improved configuration allowing to reduce the diameter of the turnaround portions. For reducing the energy needed for operating the people conveyor, it further would be beneficial to reduce the weight of the movable parts.

According to an exemplary embodiment of the invention a transportation element which is configured to be moved in a conveying direction of a people conveyor comprises a lower flange, an upper flange, and an intermediate element connecting the lower flange and the upper flange.

A transportation element according to an exemplary embodiment of the invention allows to provide a lower flange having an extension in the conveying direction which is shorter than the extension of the upper flange in the conveying direction. In consequence interference between adjacent transportation elements in the turnaround portions, in particular interference between the lower flanges of adjacent transportation elements, is reliably avoided even in case of small turnaround diameters.

Exemplary embodiments of the invention will be described in the following with respect to the enclosed figures:

FIG. 1 shows a perspective view and FIG. 2 shows a side view of a landing portion of a pallet conveyor 70.

The pallet conveyor 70, which in particular may be a people conveyor such as a moving walkway, comprises a plurality of movable pallets 7. The pallets 7 are connected to each other forming an endless pallet band which is movable in a conveying direction.

Figure 1:
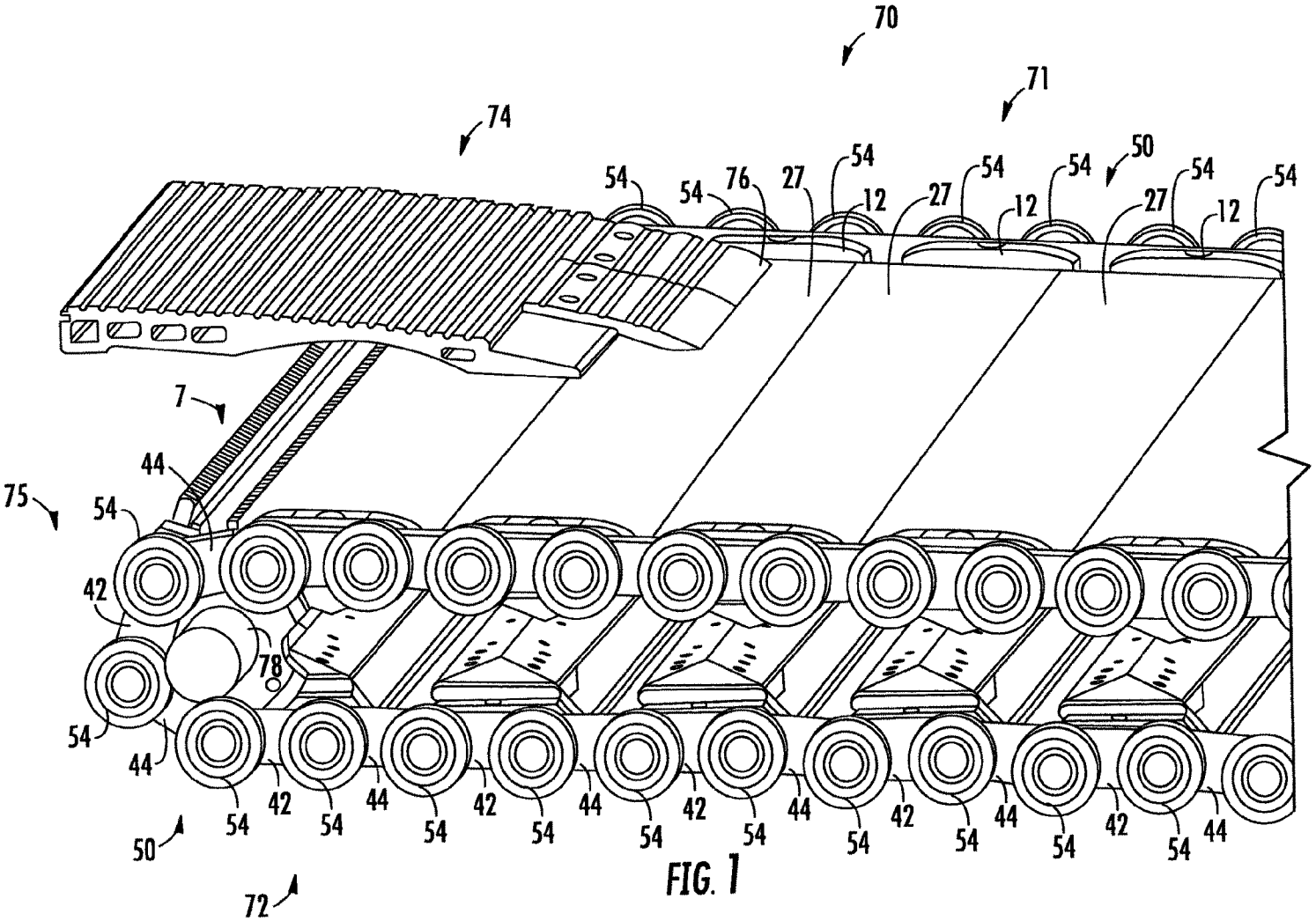
FIG. 1 shows a perspective view of a pallet conveyor according to an exemplary embodiment of the invention.
Figure 2:
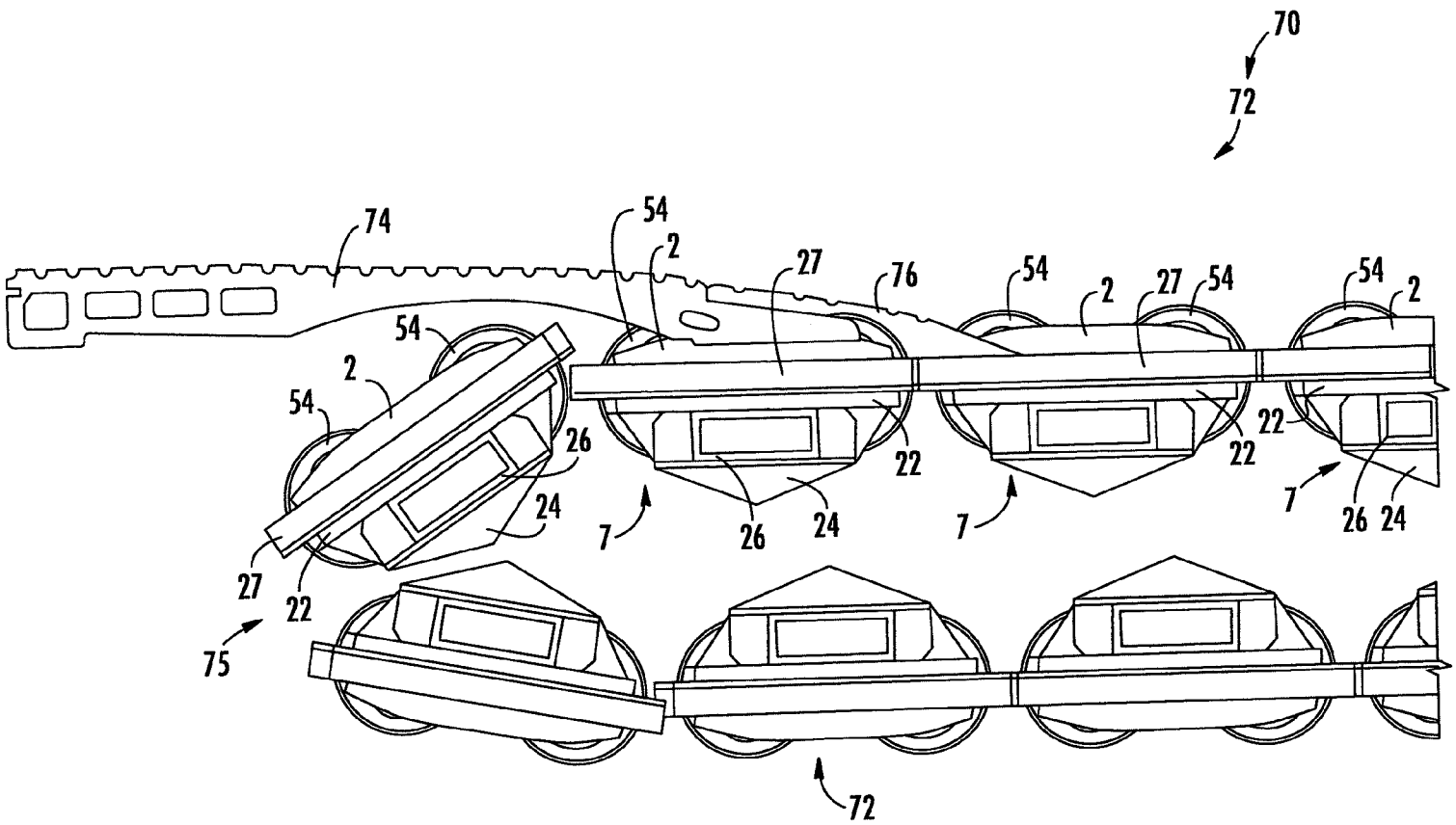
FIG. 2 shows a side view of the pallet conveyor shown in FIG. 1.
Figure 10:
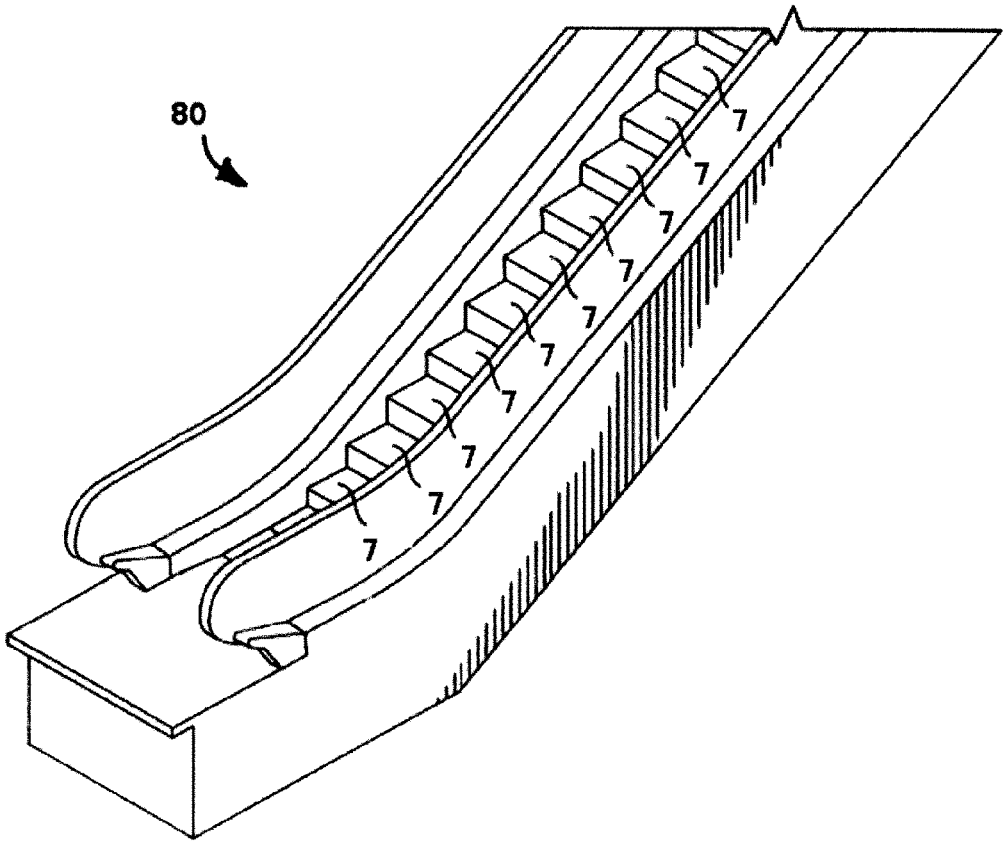
FIG. 10 shows a perspective view of an escalator according to an exemplary embodiment of the invention.

Although the conveying direction extends horizontally in FIGS. 1 and 2, it also may be arranged in an inclined orientation for allowing transportation between different levels of height. The conveyor also may be an escalator as shown in FIG. 10.

In the embodiment shown in FIGS. 1 and 2, consecutive pallets 7 are connected to each other by means of two pallet chains 50 acting as conveying elements 50 and extending on both lateral sides of the pallets 7 for forming the endless pallet band. Each pallet chain 50 comprises a plurality of outer pallet chain links 42 and inner pallet chain links 44 which are arranged alternately next to each other. The pallet chains 50 are driven by a drive (not shown in the Figures), e.g. via a sprocket, and drivingly coupled to the pallet band, such as to drive the pallet band in the conveying direction.

The pallet conveyor 70 in particular comprises an upper transportation portion 71 and a lower return portion 72. The pallets 7 in the upper transportation portion 71 move horizontally from the right side to the left side in FIGS. 1 and 2 or in the opposite direction from left to right.

The pallets 7 are in particular non-rotatably connected to the outer pallet chain links 42 by means of fixing modules 12. The fixing modules 12 are described in more detail further below with reference to FIGS. 8 and 9.

Treads (tread plates) 27 are attached to the pallets 7 for providing a moving conveying plane in the upper transportation portion 71 of the pallet conveyor 70. Passengers using the pallet conveyor 70 stand on the treads 27 in the transportation portion 71 of the pallet conveyor 70.

In order to avoid gaps within said conveying plane, the extension of each of the treads 27 in the conveying direction, i.e. the horizontal direction in FIGS. 1 and 2, is larger than the length of each of the pallet chain links 42, 44 in said conveying direction. As a result, each tread 27 covers the same distance in the conveying direction as a plurality of adjacent pallet chain links 42, 44 (in the example shown in FIGS. 1 and 2 each tread 27 covers the same distance as two adjacent pallet chain links 42, 44).

The extension of each of the treads 27 in the conveying direction results in an overhang of the treads 27 with respect to a main portion of the pallets 7. Said overhang may result in a tilting movement of the pallets 7 when a passenger traveling in the transportation portion 71 is standing on a tread 27. As one option to suppress such tilting movement, the tension of the pallet chain 50 may be controlled in a suitable manner. Particularly, the pallet chain 50 may be biased, i.e. a tension force may be applied to the pallet chain 50. The tension force may be adjusted as high as required to sufficiently suppress tilting of the tread 27 when traveling in the transportation portion 71 and subject to a typical load.

Additionally or alternatively, the tilting movement may be reduced by increasing the weight of each pallet 7.

Pallet rollers 54 are provided on the laterally outer side of each of the pallet chains 50, i.e. on the side of each pallet chain 50 which is opposite to the pallets 7. The pallet rollers 54 support the pallets 7 and the respective pallet chain links 42, 44 on guide rails (not shown in FIGS. 1 and 2) extending parallel to the pallet chain 50.

In the turnaround portions 75 (one of the turnaround portions 75 is shown on the left side of FIGS. 1 and 2, respectively) pallet chain rollers, which are arranged inside the pallet chain links 42, 44 and which are not visible in FIGS. 1 and 2, engage with the teeth of a turnaround sprocket 78 for transferring the pallet chain 50 from the upper transportation portion 71 to the lower return portion 72 or vice versa.

For allowing an unobstructed view to the pallets 7, the turnaround sprocket 78 and the pallet chain 50 are not shown in FIG. 2.

A corresponding turnaround sprocket 78 is arranged in an opposing second turnaround portion 75 of the pallet conveyor 70, which is not shown in the figures. The turnaround sprocket 78 in at least one of the turnaround portions 75 may be driven by a drive mechanism including a motor (not shown) for driving the pallet band of the pallet conveyor 70.

Alternatively or additionally a linear drive mechanism may be provided at at least one position along the transportation portion 71 and/or the return portion 72.

The turnaround portion 75 of the pallet conveyor 70 is covered by a comb plate 74 including a comb 76. The comb 76 comprises a plurality of teeth which engage with corresponding teeth formed on the top surface of the treads 27.

In the embodiment shown in FIG. 1, the turnaround sprocket 78 comprises only five teeth and has a small diameter. This results in a low height of the turnaround portion 75.

Each of the pallets 7 is non-rotatably connected to a respective one of the pallet chain links 42, 44. Hence, the pallets 7 are guided by the guiding mechanism of the pallet chain 50 throughout the endless path followed by the pallet chain 50 and the pallet band. In particular, there is no need for an additional guiding system guiding the pallets through the turnaround portions 75.

As the pallets 7 are connected to each other by at least one pallet chain link 42, 44, the pallet band is flexible enough for following very small turnaround diameters when traveling through the turnaround portions 75. This simplifies the construction, installation and maintenance of the pallet conveyor 70. With such a configuration, a very compact configuration of the turnaround sections 75 may be achieved. In particular sprockets having only a few number of teeth (e.g. a sprocket with only 5 teeth as shown in FIG. 1), and hence a small diameter, may be used. In consequence, only shallow pits are required for accommodating the turnaround sections 75. Such a configuration enhances the operational reliability of the pallet conveyor, as malfunctions, which may be caused by an additional guiding system for the pallets 7 provided in the turnaround sections 75, are avoided.

Each pallet 7 includes a lower flange 24. In order to avoid the lower flanges 24 of adjacent pallets 7 from interfering with each other in the narrow turnaround portions 75, the lower flanges 24 are formed having a triangular cross section. A broad side of the triangular cross section faces towards the tread 27, and an apex of the triangular cross section is arranged most distant from the tread 27. Such a triangular cross section of the lower flanges 24 allows for small turnaround radii as illustrated in particular in FIG. 2. Instead of the triangular cross section shown in FIGS. 1 and 2, the lower flanges 24 may have differently shaped cross sections, such as trapezoidal cross sections. The cross section also does not need to be constant in a direction perpendicular to the conveying direction.

Figure 3:
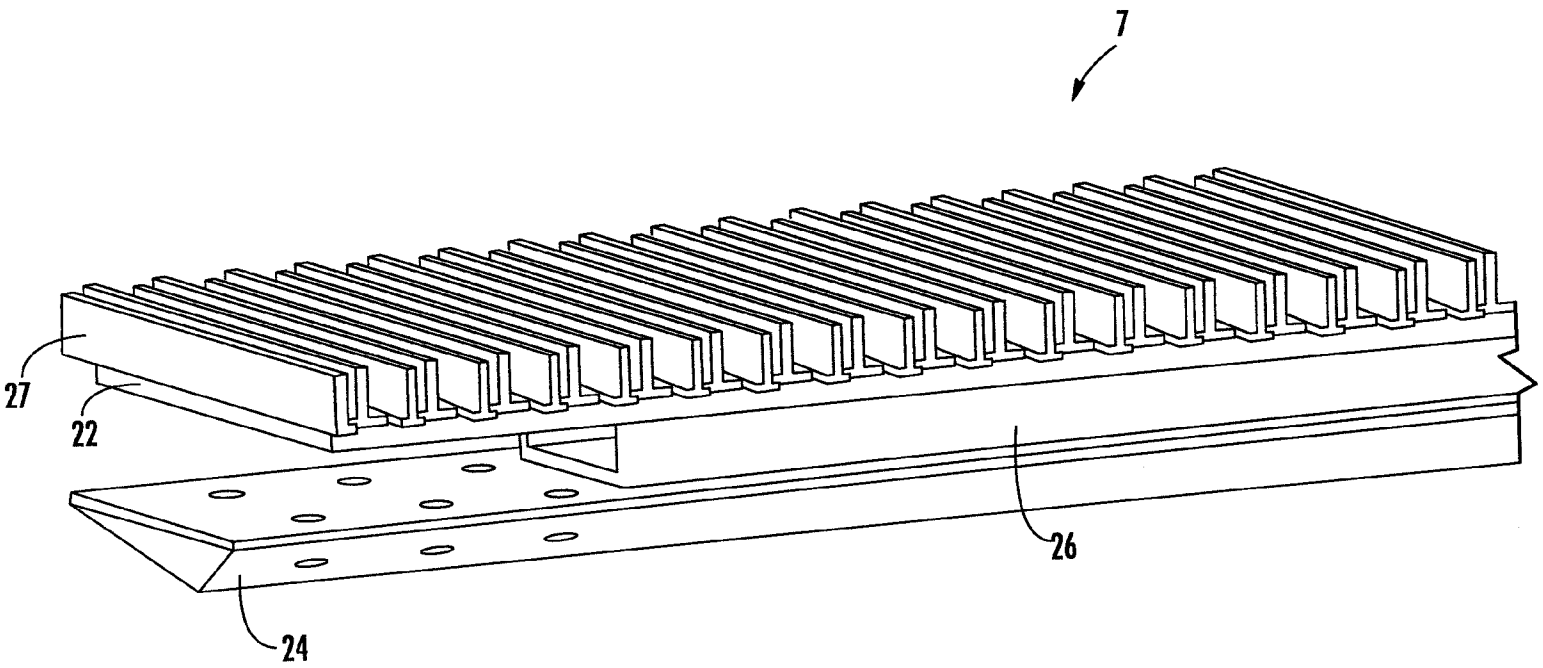
FIG. 3 shows a perspective view of a transportation element according to an exemplary embodiment of the invention.
Figure 4:
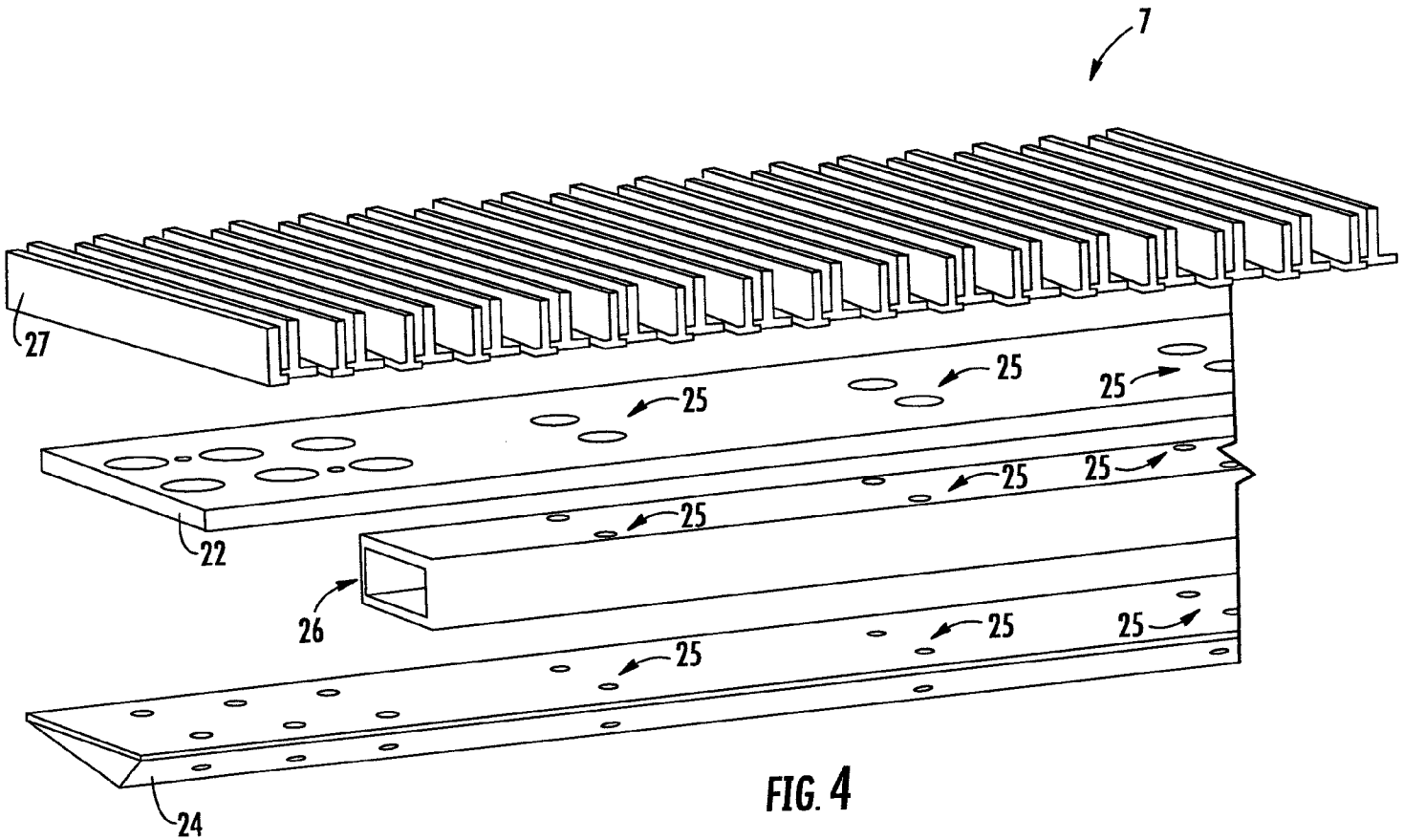
FIG. 4 shows an explosive perspective view of the transportation element shown in FIG. 3.
Figure 5:
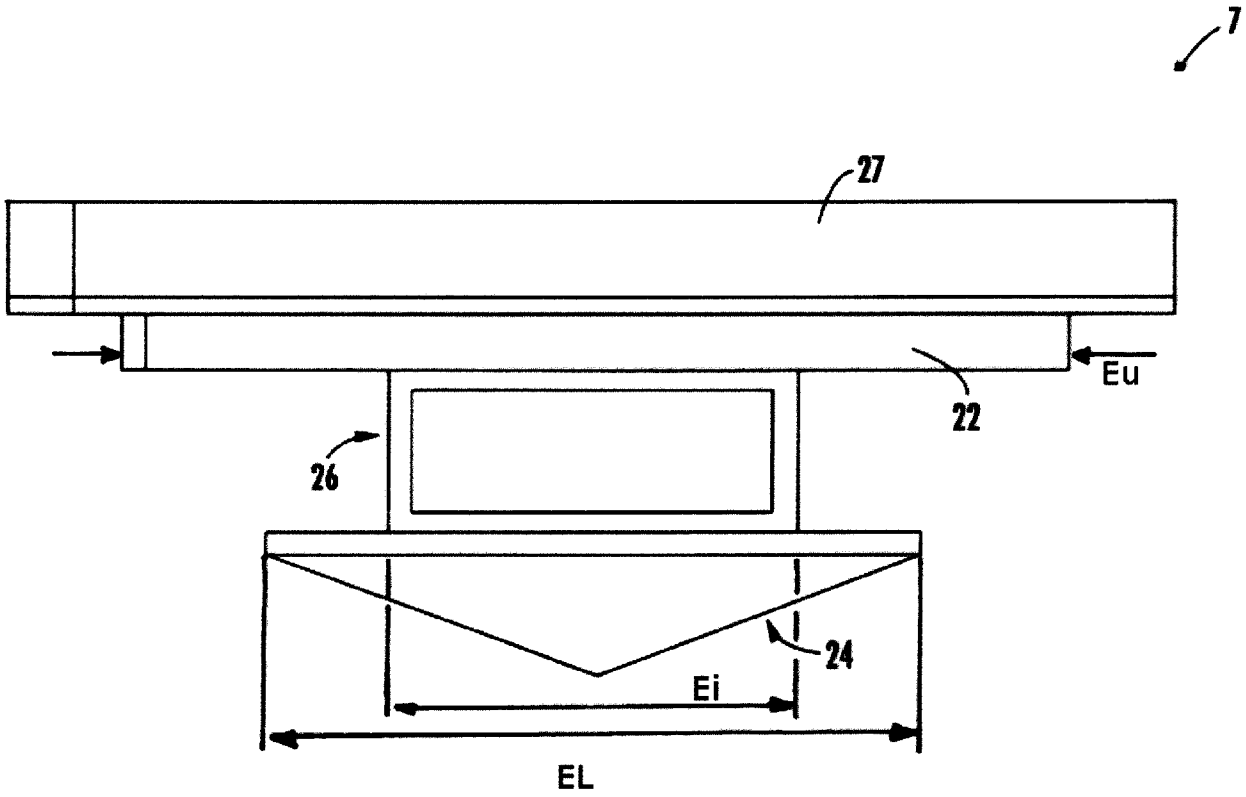
FIG. 5 shows a side view of the transportation element shown in FIGS. 3 and 4.

FIG. 3 shows a perspective view, FIG. 4 shows an explosive view and FIG. 5 shows a sectional side view of a pallet 7 according to the exemplary embodiment shown in FIG. 2.

According to said embodiment, the pallet 7 comprises an upper flange 22 for supporting the tread 27 and an opposing lower flange 24. The upper flange 22 is formed as a plate, whereas the lower flange 24 is formed as profile. For avoiding interference of the lower flanges 24 of adjacent pallets 7 in the turnaround portions 75 (see FIG. 2), the profile of the lower flange 24 has a cross section having a triangular shape.

The lower flange 24 is connected to the upper flange 22 by means of an intermediate element 26 extending between the upper flange 22 and the lower flange 24. In the embodiment shown in FIGS. 3 to 5, the intermediate element 26 is formed as a rectangular hollow profile having an extension Ei in the conveying direction.

Openings 25 are provided in the upper flange 22, in the lower flange 24 and in the intermediate element 26, respectively. The openings 25 are configured for receiving appropriate fixing elements, such as bolts or screws (not shown) for fixing the intermediate element 26 to the upper flange 22 and to the lower flange 24, respectively.

Similarly, the tread 27 may fixed to the upper flange 22, or it may be formed integrally with the upper flange 22.

Figure 6:
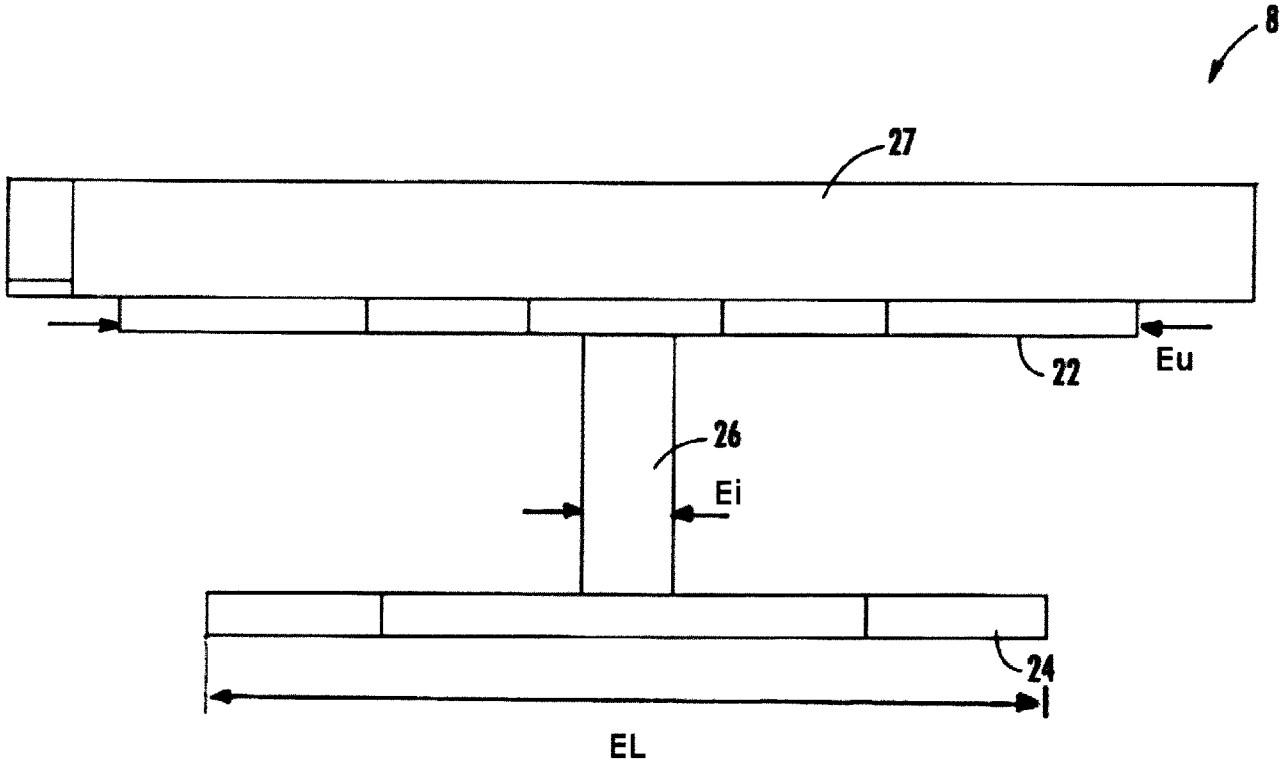
FIG. 6 shows a side view of the transportation element according to another exemplary embodiment.

FIG. 6 shows a sectional side view of a pallet 8 according to an alternative embodiment of the invention. In said embodiment, the upper flange 22 and the tread 27 are formed similarly to the embodiment shown in FIGS. 3 to 5.

In the embodiment shown in FIG. 6, the lower flange 26 is not provided in the form of a profile, but as a second plate extending basically parallel to the first plate forming the upper flange 22. For avoiding interference between the lower flanges 24 of adjacent pallets 8 in the turnaround portions 75, the extension EL of the lower flange 24 in the conveying direction (the horizontal direction in FIG. 6) is shorter than the extension Eu of the upper flange 22 in said conveying direction.

The intermediate element 26 is provided by a web extending basically perpendicularly to the conveying direction, i.e. perpendicularly to the plane spanned by each of the upper and lower flanges 22, 24.

Figure 7:
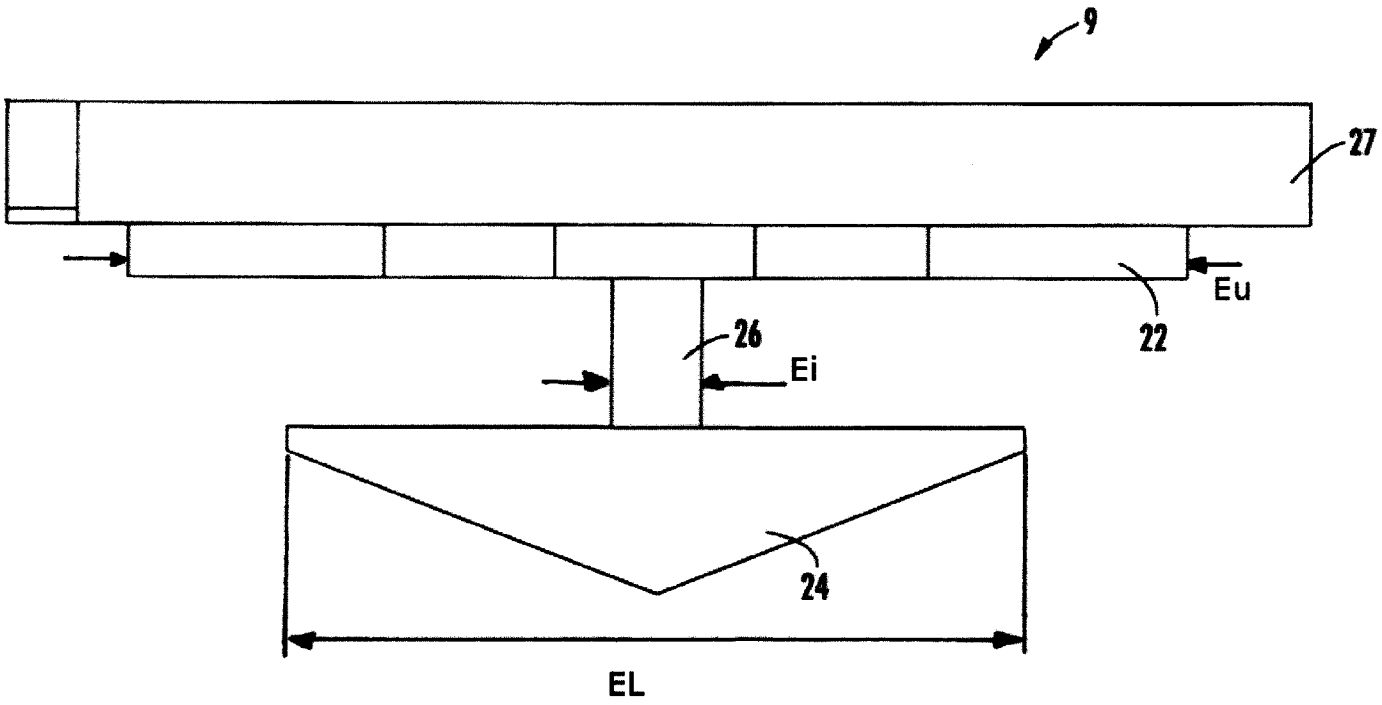
FIG. 7 shows a side view of the transportation element according to yet another exemplary embodiment.

FIG. 7 illustrates yet another exemplary embodiment of a pallet 9, in which a lower flange 24 having a triangular cross section according to the embodiment shown in FIGS. 1 to 5 is combined with an intermediate element 26 provided by a web according to the previously discussed embodiment shown in FIG. 6.

The skilled person understands that the triangular cross section of the lower flange 24 shown in FIGS. 1 to 5 and 7 is only exemplary and other shapes of the cross sections, such as trapezoidal cross sections, may be employed as well if their extension in the conveying direction on their lower side is smaller than the extension in the conveying direction on their upper side.

In all embodiments the upper flange 22 and the lower flange 24 may be made of a rigid material, such as steel or stainless steel, in order to provide the desired rigidity. For reducing the weight of the pallet 7, 8, 9, the intermediate element 26 may be made of a light material such as aluminum. The tread 27 may be made of aluminum or stainless steel or another appropriate material.

Figure 8:
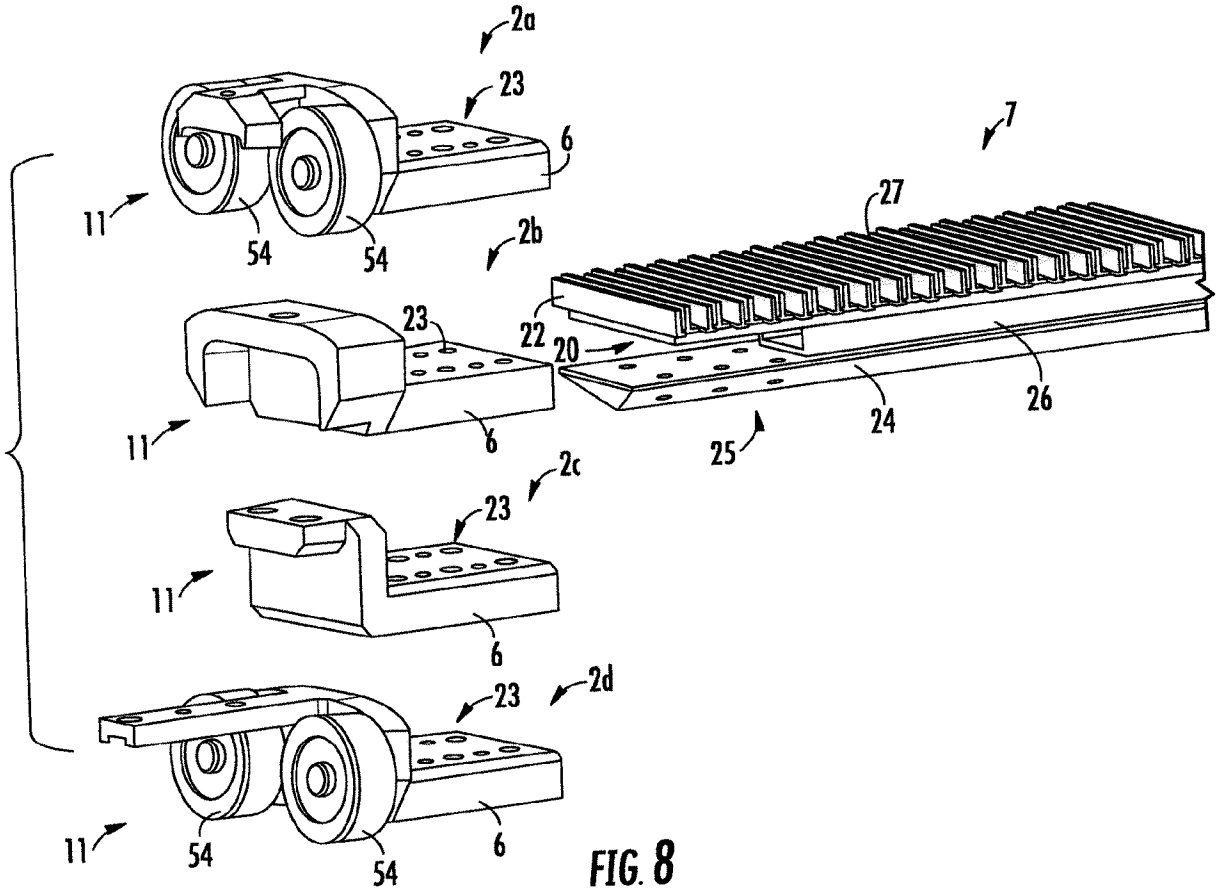
FIG. 8 shows a perspective view of a pallet according to an exemplary embodiment of the invention in combination with different fixing modules.
Figure 9:
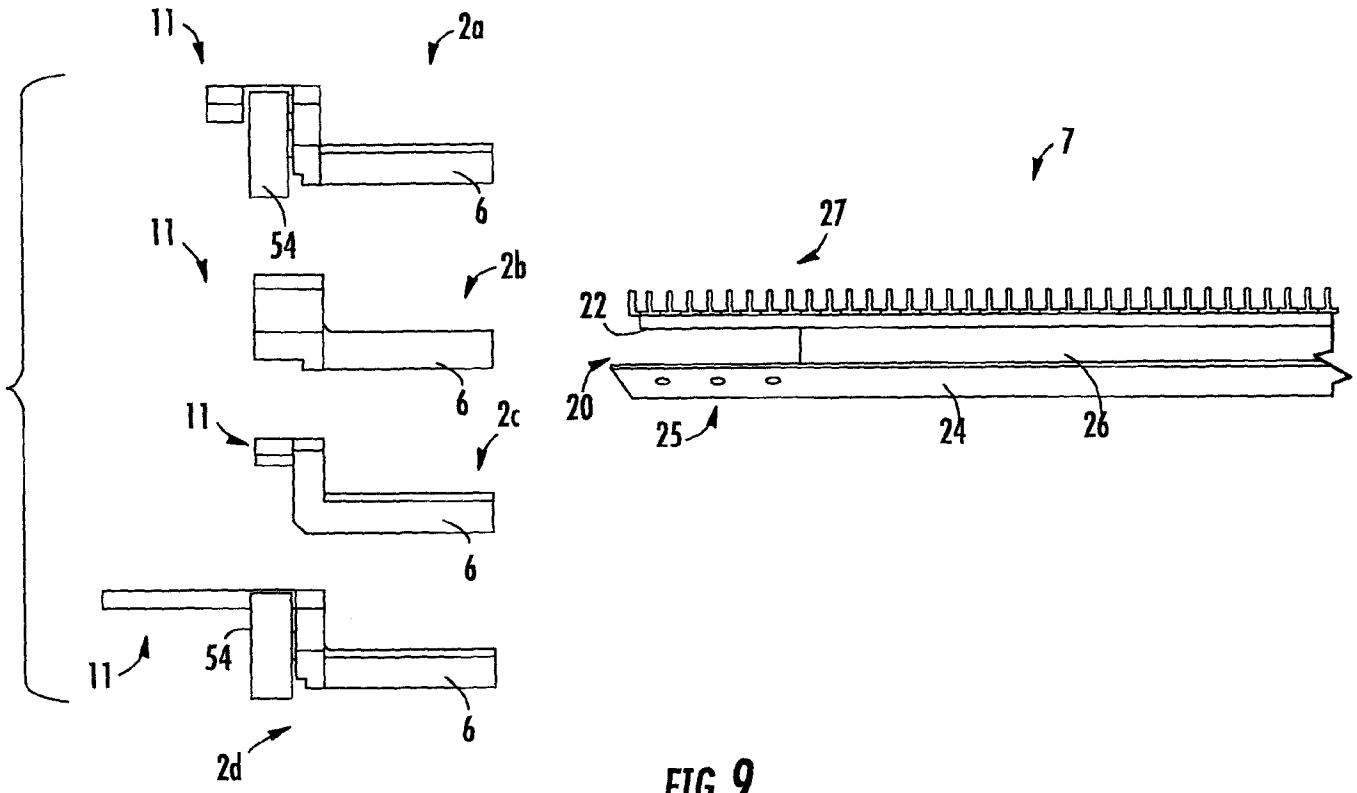
FIG. 9 shows a side view of a pallet according to an exemplary embodiment of the invention in combination with different fixing modules.

FIGS. 8 and 9 show a perspective view (FIG. 8) and a side view (FIG. 9) of a pallet 7 as it is shown in FIGS. 2 to 5 in combination with different kinds of fixing modules 2*a*-2*d*. The fixing modules 2*a*-2*d* are configured for connecting the pallet 7 to a conveying element 50, such as a pallet chain 50 (see FIG. 1) or a belt (not shown), which is configured for driving the pallets 7 along the conveying path of the pallet conveyor 71.

Each of the fixing modules 2*a*-2*d* comprises a box-shaped connection portion 6, which is configured for being received within a corresponding receiving space 20 formed between the upper and lower flanges 22, 24 of the pallet 7.

Openings 23, 25, which are configured for receiving appropriate fixing elements such as bolts or screws (not shown), are formed within the connection portions 6 and the lower flange 24 of the pallet 7, respectively. These openings 23, 25 allow to securely fix the fixing modules 2*a*-2*d* to the pallets 7 by means of the fixing elements extending through the openings 23, 25.

On the side opposite to the connection portion 6, the fixing modules 2*a*-2*d* are provided with fixing portions 11 configured for being fixed to the conveying element 50. The conveying element 50 may be selected from different kinds of pallet chains 50 (fixing modules 2*a*-2*c*) and belts (fixing module 2*d*).

The fixing modules 2*a*, 2*d* in particular may be provided with pallet rollers 54 for supporting and guiding the pallets 7 on guide rails and/or tracks (not shown) extending parallel to the transportation portion 71, to the return portion 72 and/or along the turnaround portions 75, respectively.

A number of optional features are set out in the following. These features may be realized in particular embodiments, alone or in combination with any of the other features.

In one embodiment the extension of the intermediate element in the conveying direction may be shorter than the extension of any of the upper flange and the lower flange in the conveying direction. This reduces the amount of material used for the intermediate element reducing the weight of the transportation element. It further avoids interference between adjacent transportation elements in case of small turnaround diameters.

In one embodiment the lower flange may have a tapered cross-section, in particular a triangular or trapezoidal cross-section. This reduces the extension in the conveying direction at the bottom of the transportation element even further, allowing for even smaller turnaround diameters without causing interference between adjacent transportation elements.

In one embodiment the intermediate element may comprise a rectangular profile. A rectangular profile allows to provide the necessary rigidity using a comparatively small amount of material.

In one embodiment at least one of the upper and lower flanges may be made from a different material than the intermediate element. The intermediate element in particular may be made of a lighter material, such as aluminum, than at least one of the upper and lower flanges. At least one of the upper and lower flanges may be made from a more rigid material, such as steel or stainless steel, than the intermediate element. This allows to reduce the weight of the transportation element while simultaneously providing the necessary rigidity of the upper and/or lower flanges.

In one embodiment the transportation element comprises a tread (tread plate) for supporting passengers to be transported by the conveyor. The tread may be a separate element, which is connected to the upper flange. In an alternative configuration, the tread may be formed integrally with the upper flange.

In one embodiment the intermediate element may comprise at least one opening for receiving a fixing module which is configured for connecting the transportation element to a conveying element. This allows for conveniently and securely connecting the transportation elements to the conveying element.

In one embodiment the transportation element may be a pallet of a moving walkway or a step of an escalator. Exemplary embodiments of the invention also include people conveyors such as moving walkways and/or escalators comprising a plurality of transportation elements according to exemplary embodiments of the invention. This allows to provide moving walkways and/or escalators having a smaller turnaround diameter than conventional walkways/escalators.

In one embodiment the people conveyor may comprise at least one conveying element such as a chain or belt, which is configured for conveying the transportation elements in the conveying direction.

In one embodiment the people conveyor may further comprise a plurality of fixing modules which are configured for connecting the transportation elements to the at least one conveying element. Such fixing modules allow for a secure and convenient connection between the transportation elements and the at least one conveying element.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 fixing module
6 connection portion
7 pallet
8 pallet
9 pallet
11 fixing portion
20 receiving space
22 upper flange
23 openings
24 lower flange
25 openings
26 intermediate element
27 tread
42 outer pallet chain link
44 inner pallet chain link
50 conveying element/pallet chain
54 pallet roller
70 people conveyor
71 transportation portion
72 return portion
74 comb plate
75 turnaround portion
76 comb
78 turnaround sprocket

What is claimed is:

1. A transportation element for a people conveyor, wherein the transportation element is configured to be moved in a conveying direction and comprises:

an upper flange;

a lower flange;

an intermediate element extending between and connecting the lower flange and the upper flange; and a tread, which is connected to, or formed integrally with, the upper flange;

wherein the intermediate element comprises a rectangular hollow web, the web extending basically perpendicularly to the planes spanned by the upper and lower flanges.

2. The transportation element according to claim 1, wherein an extension of the intermediate element in the conveying direction is shorter than an extension of any of the upper flange and the lower flange in the conveying direction.

3. The transportation element according to claim 1, wherein the extension of the lower flange in the conveying direction is shorter than the extension of the upper flange in the conveying direction.

4. The transportation element according to claim 1, wherein the lower flange has a tapered cross-section.

5. The transportation element according to claim 1, wherein the intermediate element comprises a rectangular profile.

6. The transportation element according to claim 1, wherein at least one of the upper and lower flanges is made from a different material than the intermediate element.

7. The transportation element according to claim 6, wherein the intermediate element is made of a lighter material than at least one of the upper and lower flanges, and/or wherein at least one of the upper and lower flanges is made from a more rigid material than the intermediate element.

8. The transportation element according to claim 6, wherein the intermediate element is made of a material comprising aluminum and/or wherein at least one of the upper and lower flanges is made of a material comprising steel.

9. The transportation element according to claim 1, wherein the intermediate element comprises at least one opening which is configured for receiving a fixing module which is configured for connecting the transportation element to a conveying element.

10. The transportation element according to claim 1, wherein the transportation element is a pallet of a moving walkway or a step of an escalator.

11. A people conveyor, in particular a moving walkway or an escalator, comprising a plurality of transportation elements according to claim 1 and at least one conveying element connecting the transportation elements to each other.

12. The people conveyor according to claim 11, wherein the at least one conveying element configured for conveying the transportation elements in the conveying direction.

13. The people conveyor according to claim 12, further comprising a plurality of fixing modules which are configured for connecting the transportation elements to at least one conveying element.

14. The people conveyor according to claim 11, wherein the at least one conveying element comprises a chain or a belt.

15. The people conveyor according to claim 12, wherein the at least one conveying element comprises a chain or a belt.

16. The people conveyor according to claim 13, wherein the at least one conveying element comprises a chain or a belt.

17. The transportation element according to claim 4, wherein the lower flange has a triangular or trapezoidal cross-section.

* * * * *